US008115416B2

(12) United States Patent
Steffen et al.

(10) Patent No.: US 8,115,416 B2
(45) Date of Patent: Feb. 14, 2012

(54) METHOD FOR GENERATING MIXED LIGHT COLORS

(75) Inventors: Eckhard Steffen, Burgthann (DE); Till Kiewning, Altdorf (DE)

(73) Assignee: Diehl Aerospace GmbH, Überlingen (DE)

( * ) Notice: Subject to any disclaimer, the term of this patent is extended or adjusted under 35 U.S.C. 154(b) by 531 days.

(21) Appl. No.: 12/266,841

(22) Filed: Nov. 7, 2008

(65) Prior Publication Data

US 2009/0121658 A1 May 14, 2009

(30) Foreign Application Priority Data

Nov. 9, 2007 (DE) ..... 10 2007 053 481

(51) Int. Cl.
*H05B 37/02* (2006.01)

(52) U.S. Cl. ..... 315/307; 315/312; 315/360

(58) Field of Classification Search ..... 315/209 R, 315/210, 211, 246, 287, 291, 294, 299, 307, 315/308, 312
See application file for complete search history.

(56) References Cited

U.S. PATENT DOCUMENTS

| | | | | |
|---|---|---|---|---|
| 7,800,315 | B2 * | 9/2010 | Shteynberg et al. | 315/291 |
| 7,902,771 | B2 * | 3/2011 | Shteynberg et al. | 315/307 |
| 2005/0117190 | A1 | 6/2005 | Iwauchi et al. | |
| 2005/0134188 | A1 | 6/2005 | Lindqvist | |
| 2005/0280375 | A1 * | 12/2005 | Chikugawa et al. | 315/291 |
| 2006/0175986 | A1 * | 8/2006 | Lee et al. | 315/312 |
| 2006/0261754 | A1 * | 11/2006 | Lee | 315/291 |
| 2007/0024210 | A1 * | 2/2007 | Zwanenburg et al. | 315/291 |

FOREIGN PATENT DOCUMENTS

| | | | |
|---|---|---|---|
| DE | 20 2005 006 910 | U1 | 1/2006 |
| DE | 10 2004 023 186 | A1 | 12/2006 |
| DE | 10 2004 047 669 | A1 | 10/2007 |
| EP | 1 482 770 | A1 | 12/2004 |
| WO | WO 20051062674 | A1 | 7/2005 |

* cited by examiner

*Primary Examiner* — Tung X Le
(74) *Attorney, Agent, or Firm* — Scully, Scott, Murphy & Presser, P.C.

(57) ABSTRACT

A method for avoiding physiological phenomena such as color separation or stroboscopic effects that occur under boundary conditions in the case of intermittent feeding in particular of light-emitting diodes, for additive superposition to form color-locus-variable mixed light, whereby the emission brightness that can be represented by a periodic duty ratio of a pulse-time-modulated constant current feeding—preferably within the respective period—is realized by changeover to other or between different constant current intensities in such a way that a brightness equivalent, namely once again the current-time integral of the predetermined, brightness-determining duty ratio, arises in the current area sum, which now preferably no longer exhibits gaps over the period.

12 Claims, 2 Drawing Sheets

$I_0 \times 0,5T \approx 0,67I_0 \times 0,75T$ $$I_0 \times 0,5T \approx I_0 \times 0,25T + 0,33I_0 \times 0,75T$$

METHOD FOR GENERATING MIXED LIGHT COLORS

BACKGROUND OF THE INVENTION

1. Field of the Invention

The present invention relates to a method for generating mixed light colors from an individually pulse-time controllable energization of light sources for colors whose brightnesses can be influenced by varying periodically successive duty ratios of the current flowing via the respective light source.

2. Discussion of the Prior Art

Measures of this type are known from DE 10 2004 047 669 A1 (in particular in connection with FIG. 3a and FIG. 4b therein). According to this document, light sources of the three primary valences (primary colors) red, green and blue are operated periodically with a constant current with duty ratios which can be set independently of one another, and their color emissions are additively mixed. Light sources such as lasers, electroluminescence elements, organic LEDs or in particular semiconductor light-emitting diodes are preferably used since their brightnesses are approximately linearly dependent on the duty ratio of the feeding with the pulse-time-modulated constant current pulses. The resultant mixed light color locus can be represented in the CIE standard chromaticity diagram depicted schematically therein (FIG. 6). This color locus can accordingly be displaced via at least one of the three primary-colored brightness contributions. Thus, each mixed light color can be set within a color triangle which is inscribed in the standard chromaticity diagram and whose corner points are given by the individual color emissions of the three primary-colored light sources used for the mixed light illumination.

Via the individual duty ratios, the respective intensity of the contribution of the primary colors to the mixed light color impression can be varied and, as a result, the color locus can be altered in a targeted manner. The shorter the periodically recurring switch-on time span, then the shorter the respective constant current pulse and thus the smaller the current-time integral of the current flow via the respective LED and accordingly the lower the brightness of the single-colored light contributed by the latter. With such brightness dynamic characteristics by way of the pulse time control, however, it is usually only possible to obtain a dimming ratio of the order of magnitude of 1:1000 between dark and bright. This no longer suffices e.g. for changing over color-variable twilight impressions in the case of extremely low brightnesses of the LEDs. Moreover particularly when, given an already high degree of dimming, small color locus corrections are additionally necessary for compensation of current-flow-dependent color locus shifts, that is to say for the so-called gamut color corrections, it should be endeavored to achieve a dimming ratio that is higher by at least one order of magnitude, that is to say an even weaker driving before the complete switching-off of the LEDs.

Precisely this gamut color correction required for high-quality, color-constant illumination effects necessitates very short current flow times via the light-emitting diodes. It is thus possible to compensate for example for the fact that the color loci of the LEDs vary owing to production. In order nevertheless to be able to represent a predetermined primary color, already during production adjustment or later during operation, the other two primary colors are admixed at extremely low intensities such as arise for the respective color locus from the CIE standard chromaticity diagram. By way of example, a guaranteed color locus "blue, unsaturated" is generated in gamut-corrected fashion by virtue of the fact that, in addition to the full driving (100%) of the blue LED, the green LED is driven at 5% and the red LED is driven at 2%. In order to represent this color locus at low brightness, for instance dimmed to 1%, in a driving period of 3 ms duration, for blue a switch-on time of 1% of the total period, that is to say 30 μs, arises, for green 1% of 5% equal to 0.05% (1.5 μs) and for red 1% of 2% equal to 0.02% (0.6 μs current flow via the red LED). Such intensive LED dimming by means of extremely short current pulses can only be realized with very fast and therefore expensive processors owing to the high coding depth required for such finely graded quantization, together with powerful high-frequency transistors as constant current sinks for the LEDs; that is to say with rarely tenable outlay on circuitry.

In order to avoid peak loads, for instance on an on-board power supply system with isolated operation, the LEDs of the three primary colors are not switched on simultaneously but rather in a manner temporally offset with respect to one another periodically in pulse-time-controlled fashion in order, on account of the integrating effect of the human eye, to produce the resultant mixed color impression. However, such differently colored pulse illuminations which are successive in different lengths, in particular if appropriate even without any mutual temporal overlaps, can physiologically be perceived as disturbing. This is because a discontinuous illumination results in a color separation effect that is disturbing to the human eye, with the result that—especially on an object moving in front of a background—no stable color locus appears under certain circumstances. In addition, the periodic colored light emissions lasting for different lengths can bring about irritating stroboscopic effects in particular on periodically moving objects which as a result are irradiated in intermittent fashion; and floating phenomena if objects are irradiated with frequencies that differ slightly from one another, such as, for instance, by light sources fed from unsynchronized power supply systems with isolated operation.

SUMMARY OF THE INVENTION

With knowledge of the conditions outlined above, the invention is based on the technical problem of extending the brightness dynamic characteristics in the case of LED mixed light towards a high degree of dimming and thus where possible simultaneously opening up an improvement of the physiological acceptance of multicolored mixed light illumination with color loci that can be set via light source energizations that can be pulse-time-modulated.

Accordingly, the constant current flow time span, which determines the emission brightness on account of the current-time integral, with an already short current flow time, is not shortened even further via each of the LEDs for further darkening; rather, a changeover is made to a lower constant current value with the current flow time being lengthened in a manner adapted thereto, with regard to the dimming state given by the current-time integral. Owing to the henceforth lower constant current intensity, the current flow time is thus again lengthened beyond the critical short duration that has already been reached before, such that it can then be shortened again for further dimming.

Since the color locus of the light of the light source, particularly when using LEDs, can drift as a result of the reduction of the constant current intensity, this must be compensated for if appropriate via the driving of a or the different-colored light source(s), in order that the mixed light generated has the desired color mixture or the (previously) determined color locus.

The changeover to the lower constant current value can be effected in principle—at least for the dimming level chosen—such that only this lower constant current flows via the relevant light source. As an alternative, however, it is also possible to effect changeover in each period a new from the regular, original constant current value to the lower constant current value and/or also between two different lower constant current values (and back). What is important, however, is that the sum of the individual current-time integrals corresponds to the current-time integral (with a regular constant current value) of the duty ratio predetermined for this period.

Preferably, the reduction of the constant current to a lower value with lengthening of the current flow time span for achieving the previous current-time integral from which further dimming is to be effected is designed in such a way that the current via the light source is no longer interrupted in the respective period. The LEDs of the colors used for the color mixture (the color locus) are therefore, in any event in the case of a high degree of dimming, no longer operated with a fixed current intensity periodically intermittently according to the duty ratio chosen for the desired brightness contribution, rather a changeover of the current intensity to at least one of, if appropriate, a plurality of available other values is effected in principle or within each period at a variable instant.

Thus, it is therefore possible during a respective period, proceeding from a high or maximum current intensity, to effect changeover to constant current feeding with a smaller current intensity for the remaining partial period; however, the situation can also occur the other way round. In particular, the smaller current intensity can also be chosen depending on the ratio of the two partial periods in continuously varying fashion in each case such that the sum of the two current integrals of the present period corresponds to the control-technological stipulation of the duty ratio of the pure constant current pulse time modulation. It is more expedient to predetermine one or a plurality of fixed current gradations and to determine the instant of the changeover between these constant currents in accordance with the predetermined sum of the current integrals.

In a corresponding manner, the period can be begun with low constant current so as later to change over to full current intensity. In particular, it is not necessary for a single-step changeover to be effected; the current integral predetermined for a specific brightness can also be summed from a plurality of current-time areas for different constant current time spans since, after all, the inertia of the human eye primarily perceives brightness integrals.

The application of this control is not restricted either to LEDs as the light sources for the three primary colors, or to using only the three primary colors; further light sources, for instance yellow and white light sources, such as can additionally be used for filling and brightening the spectrum, also experience this current variation designed according to the invention for avoiding critically short current flow time spans, as far as possible with non-intermittent driving. The method can be realized or combined with all periodically switching modulation methods such as, in particular, pulse width control or pulse frequency control of the respective current flows via the individual colored light sources.

BRIEF DESCRIPTION OF THE DRAWINGS

Additional developments of this solution according to the invention and, also with regard to the advantages thereof, are derived from the following description of a preferred exemplary realization with respect to the invention, the exemplary realization being depicted schematically in the drawing in a manner abstracted to aspects which are functionally essential. In the drawings.

DETAILED DESCRIPTION OF THE INVENTION

Figure 1:
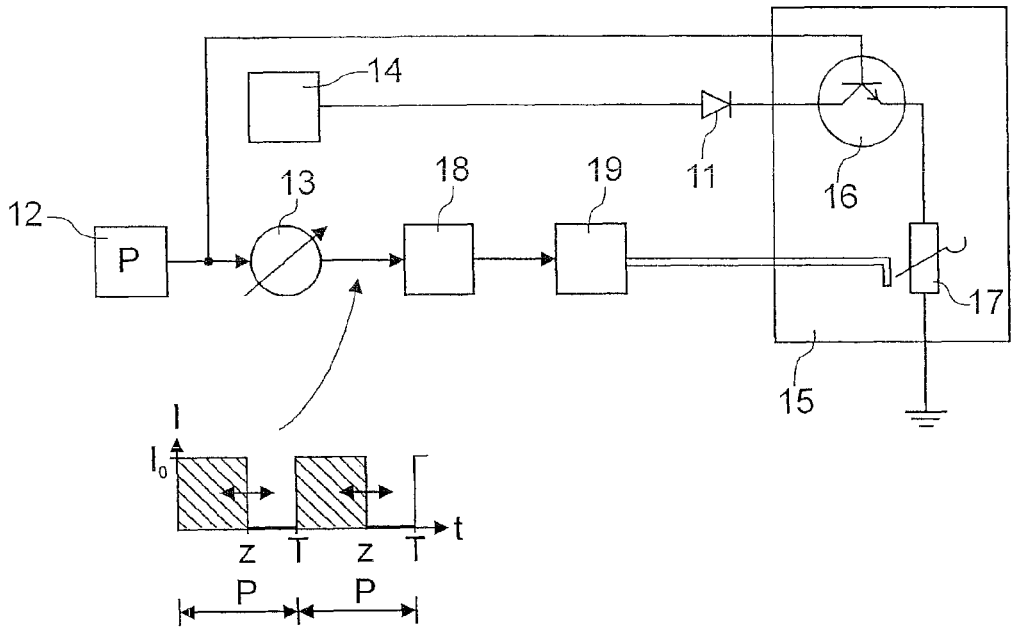
FIG. 1 shows, in a greatly simplified block diagram, a periodic current driving of a light-emitting diode with changeover of its respectively constant diode current between two predetermined current intensities with or without interruption of the current flow during the period.

The block diagram in FIG. 1 illustrates a basic example of the variable energization of an LED as a colored light source 11. In practice, a number of such light sources 11 emitting light of the same color are connected in series. For different colored light sources, the energization is effected independently of one another in the same way. The additive mixing of these color contributions with differently predeterminable brightnesses determines the color locus of the resultant mixed light color. The respective brightnesses of the color contributions are determined by the periodic current integrals.

The period P is predetermined by a timer 12. An actuator 13 is used to predetermine the emission brightness of the light source 11 as a duty ratio z/T for a specific constant current intensity, for instance the maximum or nominal current $I_0$. The current is supplied from a voltage source 14, downstream of which a constant-current current sink 15 is connected, in series with the at least one light source 11. Said current sink is realized the most simply as a bipolar transistor 16 in common-emitter connection. The emitter resistor 17 thereof determines the current via the transistor 16. By means of the latter, therefore, the instantaneous intensity of the constant current flow via the light source 11 can be changed over. However, it is also possible (contrary to the exemplary embodiment according to FIG. 1) to provide for using a transistor as pure switching stage and instead for changing over between different constant output currents at the voltage source 14.

This changeover can, on the one hand, be effected in such a way that the constant current intensity is set in principle to a lower value, the duty ratio z/T being changed in so far as the current flow time during a period P has to be lengthened in such a way that the current-time integral remains constant, in order not to alter the brightness impression. If (further) dimming of the light source 11 is desired, then the current flow time can of course be reduced or lengthened to a lesser extent in the case of a decrease in the constant current intensity, in order that the current-time integral and thus the brightness impression decrease.

The changeover to a different (lower) constant current intensity can, on the other hand, also be effected in such a way that at least once within each period P at a changeover instant z', advanced relative to the switch-off instant z of the predetermined duty period z/T, a changeover is made to a value with which the current-time integral predetermined by the duty period z/T on the control side is produced again even in the case of the henceforth changed current intensity within said period P; wherein the changeover instant z' is preferably chosen with regard to the then subsequent current intensity such that (as depicted schematically in FIG. 3) in total the predetermined current-time integral, that is to say the brightness emission that was predetermined on the control side by means of the actuator 13 with the original duty ratio z/T for this present period P, is then precisely produced again over the entire remainder T-z' of the period P; with the result that intermittent energization of the light source 11 resulting from the duty ratio z/T no longer occurs, rather identical brightness is then established with uninterrupted energization in the case of changing constant current intensities within each of the successive periods P.

The displacement—dependent on the predetermined current change—of the switching instant from z to z' within the period P is therefore determined by a computer 18, according to the duty ratio z/T specified for the desired brightness, in such a way that the current-time integral is maintained over the period P as a result. Accordingly, a changeover switch 19 is driven at the instant z' within the period P in order to bring about the current change at the voltage source 14 or, as illustrated, at the current sink 15. In so far as a temperature- or current-dependent color locus drift is to be expected (such as, in particular, in the case of light-emitting diodes that emit red light and those that emit green light), a gamut color locus correction adapted to the new current intensity is predetermined by a (slightly) altered driving of different-colored light-emitting diodes in the programming of the computers 18 of said different-colored LEDs, preferably by tabular indication of the resultant color loci which are assigned to specific current intensities through the colored light sources currently being operated. By means of such very slight influencing of the color mixing, a for instance current-intensity-dependent drift of the color locus from the predetermined position in the color triangle is compensated for. It is thus possible in particular also to effect a continuously adapted compensation of color locus shifts that occur in current-dependent fashion with low degrees of dimming, in order always to comply with a predetermined color locus independently of the degree of dimming.

Figure 2:
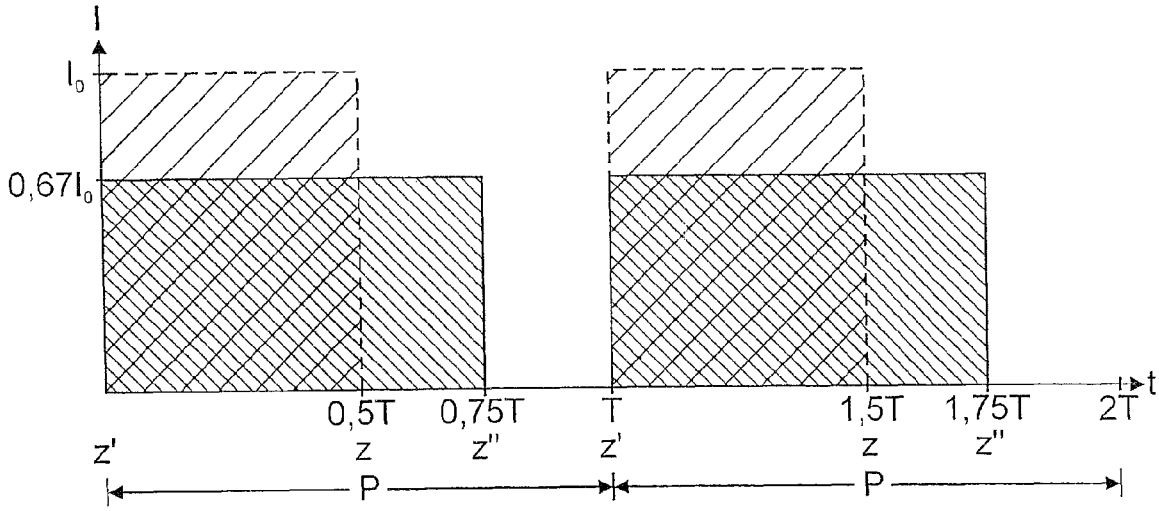
FIG. 2 shows an example of the driving according to FIG. 1 in a timing diagram.

FIG. 2 shows a timing diagram of a configuration of the driving according to the invention wherein the constant current intensity is lowered or set to 0.67 $I_0$ already at the beginning of the period P (that is to say fundamentally). In order to achieve the same brightness impression, it must be ensured that the current-time integral remains constant during a period with respect to the originally set duty ratio z/T (constant current intensity of $I_0$ for a current flow time span of 0.5 T). Therefore, at the lower constant current intensity of 0.67 $I_0$, the current flow time span until the switch-off instant z" is to be set to 0.75 T.

For further dimming of the light source it is then possible, as usual, to shorten the current flow time span until—in the case of a very short current flow time span—the constant current intensity is in turn lowered with a current flow time which is first actually lengthened again, which can then in turn be shortened for even further dimming. Very much greater degrees of dimming can be achieved in this way than by means of conventional pulse width modulation with uniform constant current intensity.

Of course, in this case, too, the current-intensity-dependent drift of the color locus of the light source 11, particularly when using a light-emitting diode, must be compensated for by a corresponding readjustment of different-colored light sources, in order that the color impression does not change as a result of the dimming operation.

A further advantage arises if the lowering of the constant current intensity is performed in such a way that the lengthening—necessary as a result of this—of the current flow time span has the effect that the light source 11 no longer has to be switched off over the entire period P, but rather can be operated continuously. In the exemplary embodiment in accordance with FIG. 2, this operation with current that is now no longer intermittent would arise in the case of a lowering of the constant current intensity to 0.5 $I_0$, at which the current flow time span would have to be lengthened to 1.0 T.

Figure 3:
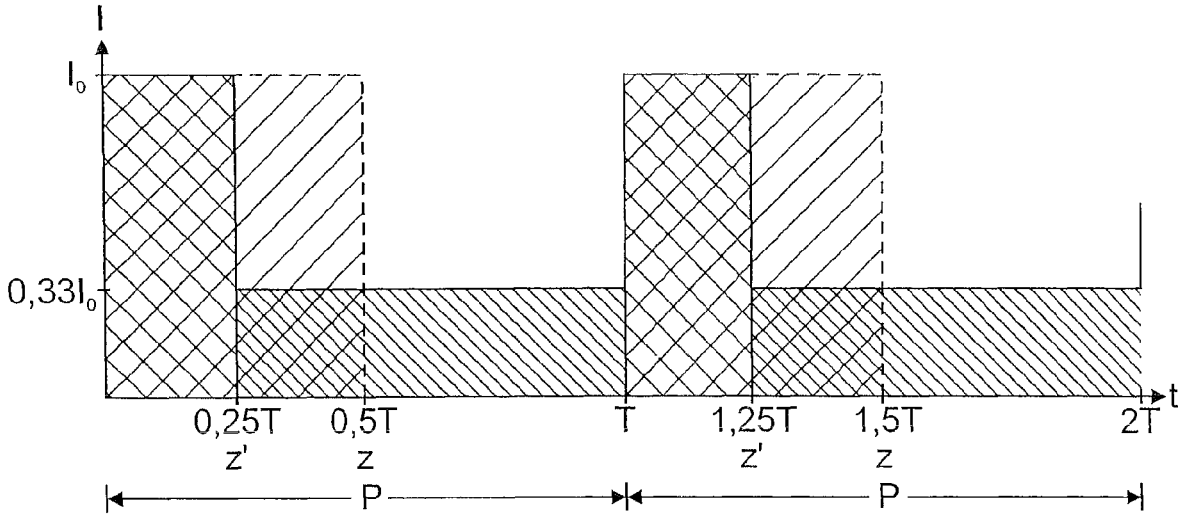
FIG. 3 shows a further example of the driving according to FIG. 1 in a timing diagram.

In accordance with the time sequence depicted schematically in FIG. 3, a duty ratio z/T of 50% of the pulse time control shall again be predetermined at the beginning of a period P for the light intensity in the case of full constant current $I_0$. In order to avoid an excessively great shortening of the current pulse and in this case preferably at the same time also a current gap, that is to say a switching-off of the light source, during the residual remainder T-z of said period P, a changeover to a lower predetermined constant current $I_0/3$ is already made at the changeover instant z' before the switch-off instant z=0.5 T is reached. The changeover instant z' is at z'=0.25 T because then in this example the $$\text{predetermined current integral } I_0 \times z = 0.5 \text{ is composed of } I_0 \times z' + 0.3\, I_0 \times (T - z') = 0.5$$

that is to say that the intended brightness with a longer current pulse is established again, and without the current being interrupted.

It can nevertheless be subliminally perceived as disturbing if a large crest factor, as it is called, is present since the light source has to react to a very large current gradient with the beginning of each period on account of the switching-on of the full current. Therefore, it may be expedient, for instance after current attenuation in one or a plurality of steps towards the middle of the period, then to increase the current again in mirror-inverted fashion, that is to say in the opposite direction. This reduces the crest factor in a desirable manner since the period then ends with the current intensity with which it commenced and will commence again in the next period. With little control-technological complexity, the crest factor is also already reduced further by the lowered current flow in each case being raised before the end of the period for example to half of the maximum value with which the subsequent period starts until the first changeover instant.

Thus, physiologically disturbing phenomena, such as color separation or stroboscopic effects, that occur under boundary conditions in the case of intermittent feeding in particular of light-emitting diodes, for additive superposition to form color-locus-variable mixed light, are avoided by virtue of the fact that the emission brightness that can be determined by a periodic duty ratio of a pulse-time-modulated constant current feeding is realized within the respective period by changeover between different constant current intensities such that a brightness equivalent, namely once again the current-time integral of the predetermined, brightness-determining duty ratio, is produced in the current area sum, which preferably no longer exhibits any gaps over the period. Such a changeover can be effected already with the beginning of the period P (i.e. z'=0.0 T) or else not until within the period P (e.g. z'=0.25 T) and furthermore also repeatedly.

LIST OF REFERENCE SYMBOLS

11 Light source, in particular LED
12 Timer
13 Actuator
14 Voltage source
15 Current sink
16 Transistor
17 Emitter resistor
18 Computer

What is claimed is:

1. A method for generating mixed light colors from an individually pulse-time-controllable energization of light sources (11) for colors having brightness which are influenceable by varying periodically successive duty ratios of a current flowing via the respective light source (11), wherein apart from a constant current intensity of a regular energization, at least one lower constant current intensity is made available for the light sources and the current intensity of the current flowing via one of the light sources (11), with a simultaneous lengthening of the current flow time span within the period (P), is reduced to said at least one lower constant current intensity, wherein an arising total current-time integral corresponds to a current-time integral of the duty ratio predetermined for the period, and a current-dependent drift of a color locus of the light of this light source (11) is compensated for by a changed driving of different-colored light sources.

2. The method according to claim 1, wherein within the period (P), a changeover instant (z') is brought forward relative to the switch-off instant (z) of the duty ratio (z/T) predetermined for a brightness, while concurrently the future current intensity is reduced, and the current flow time span is lengthened, to such an extent and in a manner whereby the total current-time integral remains constant.

3. The method according to claim 1, wherein for the reduced current intensity, the changeover instant (z') is selected such that current gaps do not occur during the respective period (P).

4. The method according to claim 1, wherein the instant for the changeover to a different one of said constant current intensities is determined from a brightness stipulation of the current-time integral of the pulse time control.

5. The method according to claim 4, wherein the changeover instant (z') determined for the current-time integrals experiences a shift according to the current-dependent drift of the color locus of a light from a light source.

6. The method according to claim 1, wherein the current intensity is lowered in a plurality of steps at different changeover instants (z') within the period (P).

7. The method according to claim 1, wherein at a changeover instant before the end of the period (P), the current is amplified until the end of the period (P) once again to the value as at the beginning of said period (P) or to a fraction of said value.

8. The method according to claim 7, wherein in the current flow is reduced in a stepped sequence until the middle of the period (P) and is then increased again until the end of the period (P) in mirror-inverted similar steps.

9. The method according to claim 1, wherein as colored light sources (11) there are operated light-emitting diodes with constant currents.

10. The method according to claim 1, wherein the colored light sources (11) are supplied from a voltage source (14) with switchably constant output currents, or selectively, the colored light sources (11) are energized via switchable constant current sinks (15) with bipolar transistors (16).

11. The method according to claim 1, wherein the constant current intensity of the regular energization is used for a primary dimming and said at least one lower constant current intensity with a simultaneous lengthening of the current flow time span within the period (P) is used for at least one corresponding secondary dimming.

12. The method according to claim 11, wherein each of said at least one corresponding secondary dimming is used when said current flow time span within the period is at a predetermined duty cycle within said period.

* * * * *